US009248985B2

(12) United States Patent
Kawauchi

(10) Patent No.: US 9,248,985 B2
(45) Date of Patent: Feb. 2, 2016

(54) SHEET FEEDING APPARATUS AND IMAGE READING APPARATUS

(71) Applicant: Yoshikazu Kawauchi, Nagoya (JP)

(72) Inventor: Yoshikazu Kawauchi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/229,441

(22) Filed: Mar. 28, 2014

(65) Prior Publication Data

US 2014/0292173 A1 Oct. 2, 2014

(30) Foreign Application Priority Data

Mar. 29, 2013 (JP) ..... 2013-071948

(51) Int. Cl.
*B65H 3/06* (2006.01)
*B65H 3/52* (2006.01)

(52) U.S. Cl.
CPC ..... *B65H 3/06* (2013.01); *B65H 3/5238* (2013.01); *B65H 2402/441* (2013.01); *B65H 2407/20* (2013.01); *B65H 2601/324* (2013.01)

(58) Field of Classification Search
CPC ..... B65H 3/5223; B65H 2404/71; B65H 3/5238; B65H 2402/441
See application file for complete search history.

(56) References Cited

U.S. PATENT DOCUMENTS

| | | | | |
|---|---|---|---|---|
| 4,865,306 | A | 9/1989 | Himegi | |
| 7,618,036 | B2 * | 11/2009 | Ikeda | 271/121 |
| 8,496,241 | B2 * | 7/2013 | Osakabe | B65H 3/5223 271/121 |
| 8,730,542 | B2 * | 5/2014 | Nakamura | B65H 3/06 271/278 |
| 2002/0038932 | A1 | 4/2002 | Kaiga et al. | |

FOREIGN PATENT DOCUMENTS

| | | | |
|---|---|---|---|
| JP | S61-142738 | U | 9/1986 |
| JP | S63-208451 | A | 8/1988 |
| JP | S64-28135 | A | 1/1989 |
| JP | H03-118951 | U | 12/1991 |
| JP | H05186081 | A | 7/1993 |
| JP | H0583771 | U | 11/1993 |
| JP | H08169581 | A | 7/1996 |
| JP | H08231069 | A | 9/1996 |
| JP | H09278209 | A | 10/1997 |
| JP | H09309638 | A | 12/1997 |
| JP | 2000219347 | A | 8/2000 |
| JP | 2001088963 | A | 4/2001 |
| JP | 2002087616 | A | 3/2002 |
| JP | 2002104680 | A | 4/2002 |
| JP | 2002128305 | A | 5/2002 |
| JP | 2004059170 | A | 2/2004 |
| JP | 2005-060091 | A | 3/2005 |
| JP | 2009051629 | A | 3/2009 |
| JP | 2009274814 | A | 11/2009 |

OTHER PUBLICATIONS

Aug. 18, 2015—(JP) Notice of Reasons for Rejection—App 2013-071948.

* cited by examiner

*Primary Examiner* — Howard Sanders
(74) *Attorney, Agent, or Firm* — Banner & Witcoff, Ltd.

(57) ABSTRACT

A sheet feeder configured to hold a separation pad may include a pivotable housing having a connection element for attaching the separation pad. In one example, the connection element may correspond to a protrusion, with the separation pad including one or more corresponding recesses or holes. A fixing member configured to secure the separation pad may be slidably connected in the housing to be slidable, while connected to the housing, between a first position and a second position.

21 Claims, 10 Drawing Sheets

SHEET FEEDING APPARATUS AND IMAGE READING APPARATUS

CROSS REFERENCE TO RELATED APPLICATIONS

This application claims priority to Japanese Patent Application No. 2013-071948 filed on Mar. 29, 2013, the disclosure of which is herein incorporated by reference in its entirety.

FIELD

The present disclosure relates to a sheet feeding apparatus that feeds a sheet, and an image reading apparatus that reads an image on the sheet fed by the sheet feeding apparatus.

BACKGROUND

In a sheet feeding apparatus that feeds a sheet, the sheet is fed through the gap between a roller and a separation pad. The roller rotates and feeds the sheet. The separation pad is disposed in a position facing the roller to provide a feed resistance to the sheet. Even when a plurality of sheets are held in a stack, the sheets can be separated and fed one at a time by feeding the sheets through the gap between the roller and the separation pad. In some examples, a combined separation pad may include a separation pad attached to a holder made of hard resin or the like. The combined separation pad is detachably attached to a housing of the sheet feeding apparatus.

BRIEF SUMMARY

However, when a separation pad is attached to a housing of a sheet feeding apparatus, a component such as a holder may be required, as discussed in the above example of a combined separation pad. The increase in the number of components may increase production costs of the apparatus and a size of the apparatus.

Aspects described herein relate to a sheet feeding apparatus in which a separation pad can be detachably attached directly to a housing, and an image reading apparatus (e.g., without requiring a holder).

One or more other aspects relate to a sheet feeder comprising a pivotable housing having a connection element configured to receive attachment of a separation pad. In one example, the housing is pivotable between an abutting position and a separation position about an axis extending in a first direction. The separation pad may, in some examples, include another connection element configured to attach to the connection element of the pivotable housing. According to some arrangements, the separation pad contacts the first roller when the separation pad is attached to the pivotable housing and the pivotable housing is in the abutting position and is separated from the first roller when the separation pad is attached to the pivotable housing and the pivotable housing is in the separation position. A fixing member may be configured to contact the separation pad and to be slidable, while connected to the pivotable housing, between a first position and a second position. For example, the fixing member may slide along a first surface of the separation pad. The sheet feeder may be used in various systems include an image reading apparatus and the like.

DETAILED DESCRIPTION

An embodiment of the present disclosure will be described by an example. In this embodiment, an image reading apparatus 1 is configured to read an image on a document and to generate data according to the read image. The image reading apparatus 1 is capable of storing generated data in a detachable storage medium such as a memory and/or sending generated data to an external storage device such as a HDD (hard disk drive) of a personal computer through wire or wireless communication. In the following description, in order to make the relative positional relationship between parts of the image reading apparatus 1 easy to understand, the directions "up", "down", "left", "right", "front", and "rear" shown in the figures will be used. To facilitate understanding of the orientation and relationship of the various elements disclosed herein, the front, rear, left, right, top, and bottom of the image reading apparatus 1 may be determined with reference to axes of the three-dimensional Cartesian coordinate system included in each of the relevant drawings.

Figure 1:
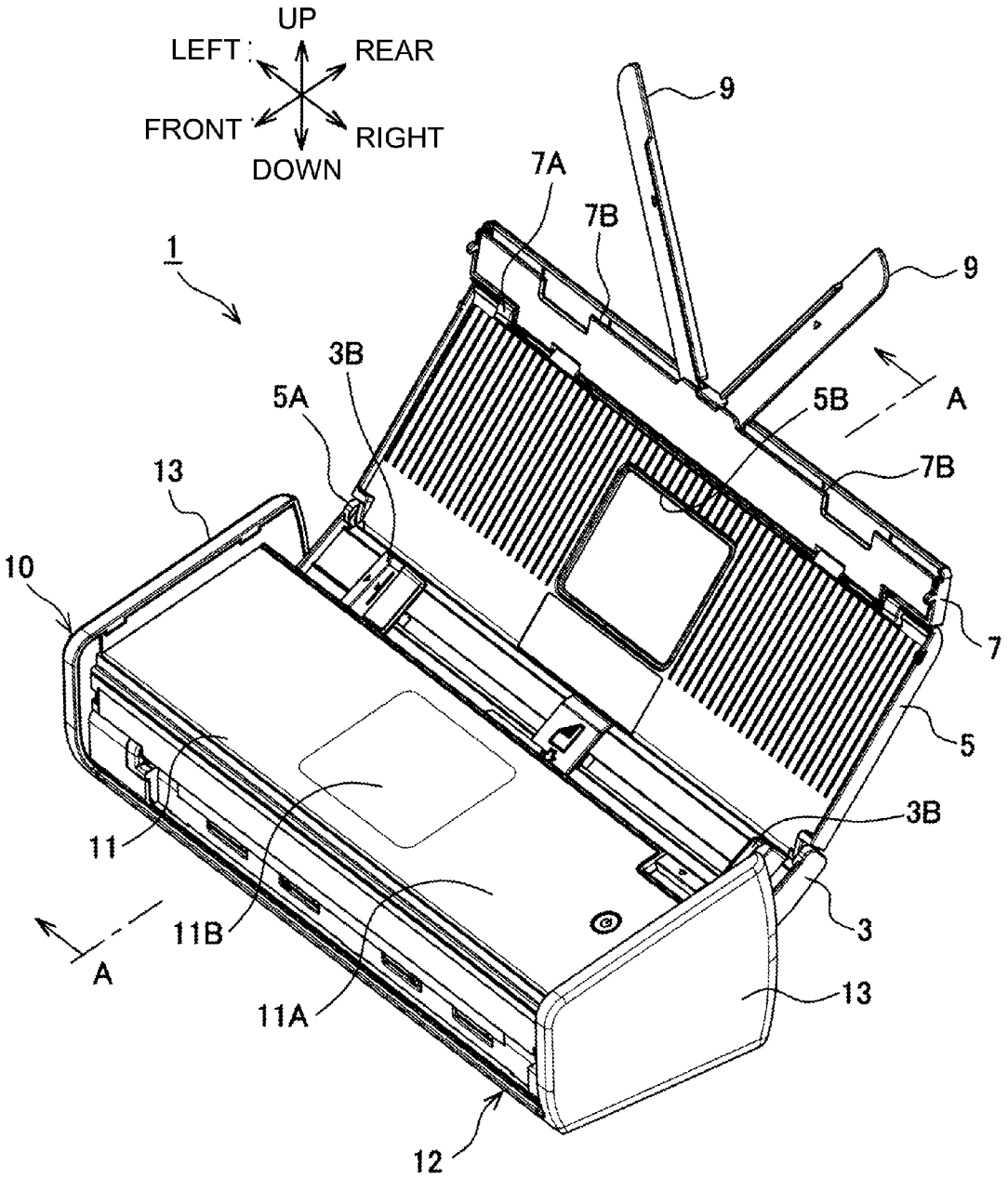
FIG. 1 is a perspective view showing an example image reading apparatus with trays in an open position.

As shown in FIG. 1, the image reading apparatus 1 has a first tray 3, a second tray 5, a third tray 7, and a pair of extension trays 9. The first tray 3, the second tray 5, the third tray 7, and the pair of extension trays 9 hold sheets such as documents. The first tray 3, the second tray 5, the third tray 7, and the pair of extension trays 9 are configured to open and close around a housing 10 that forms the main body of the image reading apparatus 1.

The first tray 3 is provided in the rear part, e.g., the upstream part in the sheet feed direction, of the housing 10. The first tray 3 is configured to rotate about an axis extending in the left-right direction with a hinge 3A (see FIG. 7). The second tray 5 is connected to one end of the first tray 3 opposite to the housing 10 and rotatable about an axis extending in the left-right direction with a hinge 5A. The third tray 7 is connected to one end of the second tray 5 opposite to the first tray 3 and rotatable about an axis extending in the left-right direction with a hinge 7A.

When the first tray 3, the second tray 5, and the third tray 7 are opened away from the housing 10, surfaces of the first tray 3, the second tray 5, and the third tray 7 form a surface (e.g., a continuous surface) for holding sheets such as documents as shown in FIG. 1. The pair of extension trays 9 is provided on one end of the third tray 7 opposite to the second tray 5. The extension trays 9 are rotatable about a pivot provided in the center of third tray 7 in the left-right direction. By spreading the extension trays 9, the third tray 7 can be extended. The extension trays 9 are retracted into the third tray 7 through openings 7B formed in the one end of the third tray 7 opposite to the second tray 5.

Figure 2:
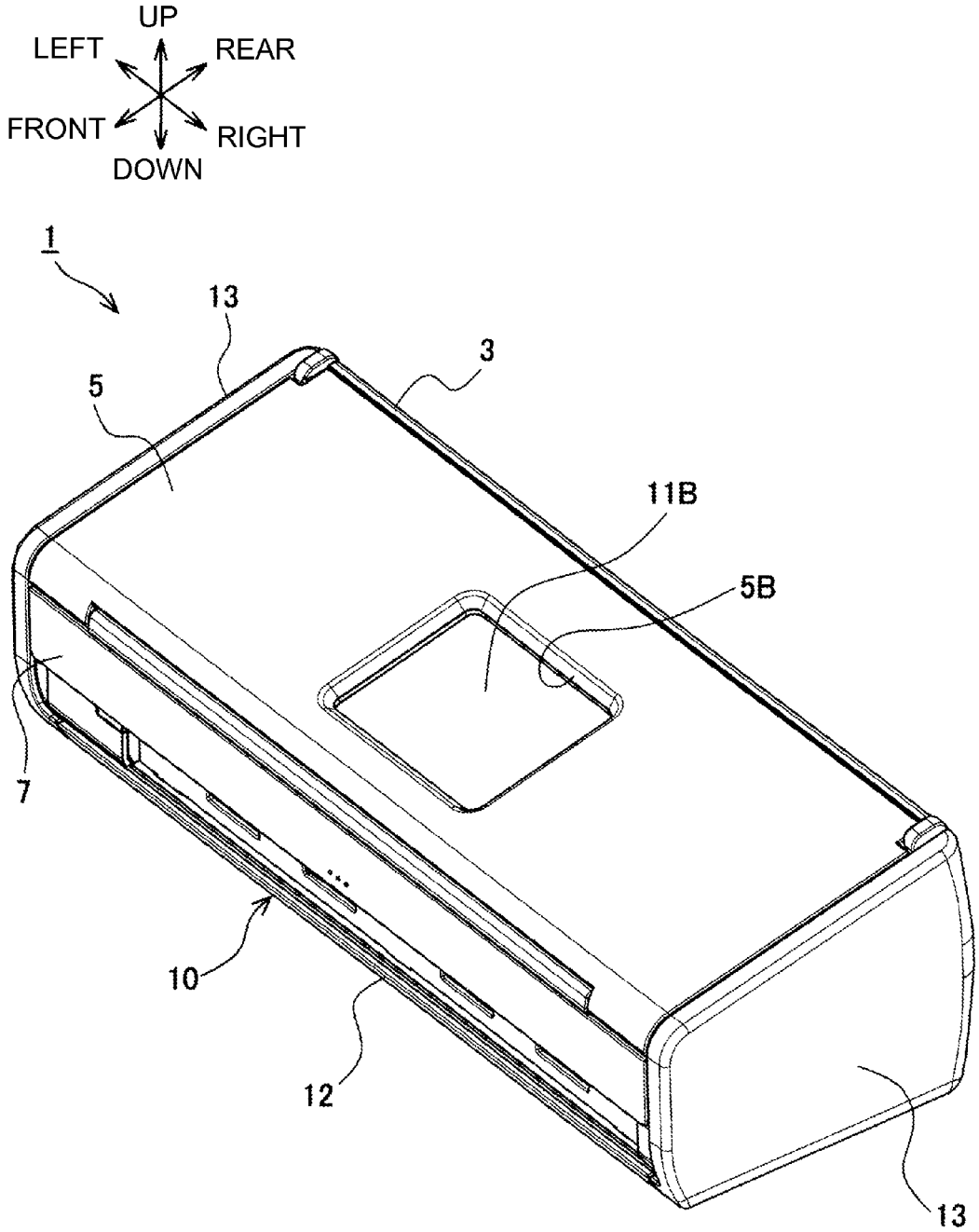
FIG. 2 is a perspective view showing the example image reading apparatus of FIG. 1 with the trays in a closed position.

When the extension trays 9 are refracted into the third tray 7, and the first tray 3, the second tray 5, and the third tray 7 are closed toward the housing 10, the first tray 3, the second tray 5, and the third tray 7 are disposed so as to conform to the outer surface of the housing 10 as shown in FIG. 2.

Figure 3:
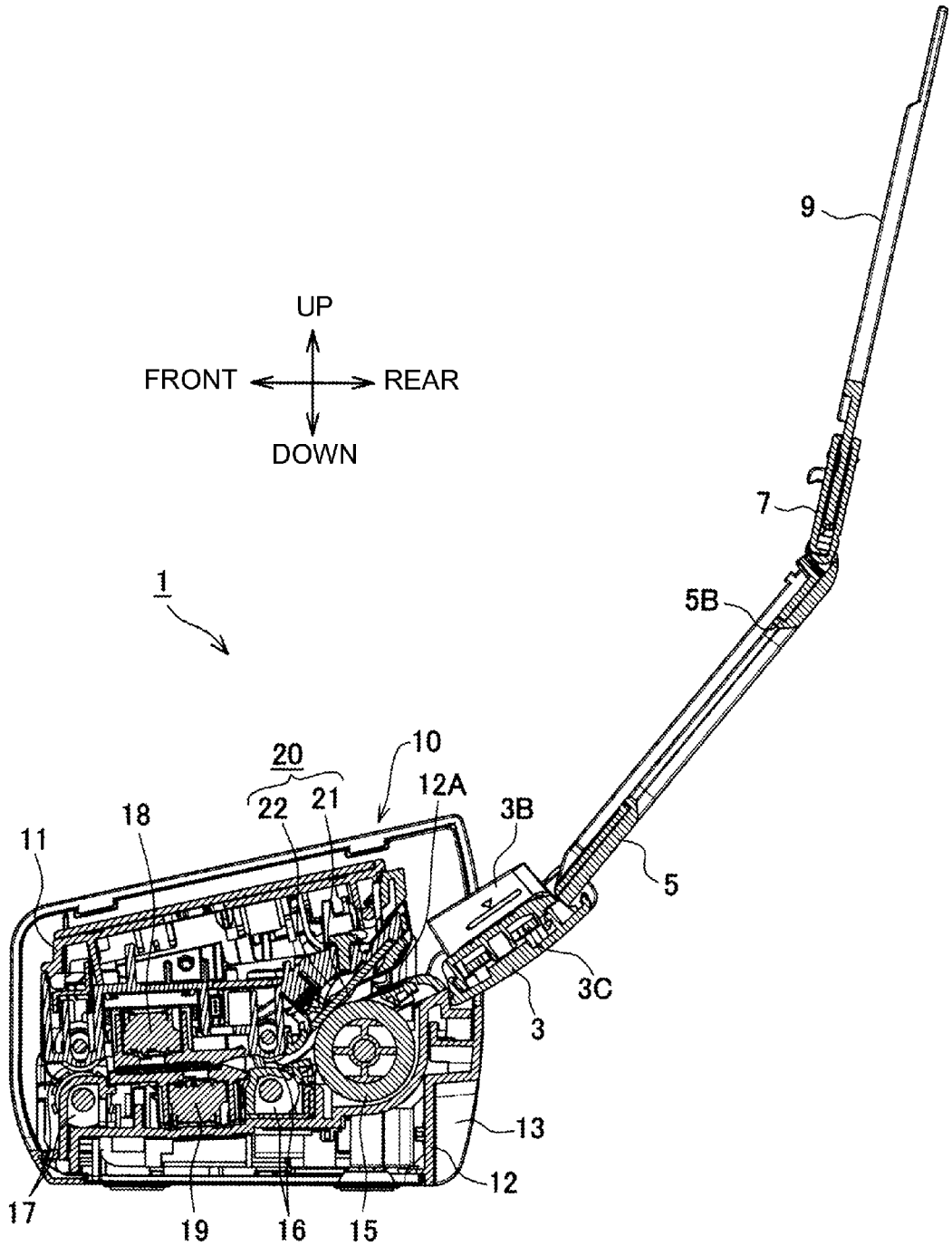
FIG. 3 is a sectional view taken along line A-A of FIG. 1.

As shown in FIG. 1 and FIG. 3, the housing 10 has a first housing 12, a second housing 11, and a pair of side plates 13. The second housing 11 is disposed above the first housing 12 in the orientation shown in FIGS. 1 and 3. The pair of side plates 13 is provided on the left and right sides of the second housing 11 and the first housing 12. As shown in FIG. 3, a chute 12A is formed on the upper surface of the first housing 12. The chute 12A forms a sheet feed surface together with the opened first tray 3. A separation roller 15, an example of a first roller, is exposed at the rear end of the chute 12A from below. A contact surface 21A of a separation pad 21, an example of a first surface, is in contact with the upper surface of the separation roller 15 (see FIG. 4). When sheets (not shown), such as documents, are held on the opened first tray 3, the second tray 5, and the third tray 7, and when the separation roller 15 is driven, the sheets are fed forward through the gap between the separation roller 15 and the separation pad 21 one at a time in an order starting with the sheet in contact with the separation roller 15. The separation pad 21 forms a separation pad assembly 20 together with a film 22. The position in the left-right direction of the fed sheet is defined by a pair of guides 3B provided on the first tray 3. The pair of guides 3B is symmetrically interlocked with respect to the center in the left-right direction by a rack-and-pinion interlocking mechanism 3C.

As shown in FIG. 3, a pair of upper and lower feed rollers 16 is provided in front of the separation roller 15 in the housing 10 (e.g., downstream of the separation roller 15 in the sheet feeding direction). A pair of upper and lower paper ejection rollers 17 is provided at the front ends of the second housing 11 and the first housing 12. The sheet fed forward by the separation roller 15 is then fed through the feed rollers 16 to the paper ejection rollers 17. The paper ejection rollers 17 eject the fed sheet to the outside of the housing 10. A pair of contact image sensor (CIS) units 18 and 19, an example of a reader, configured to read images on the sheet from both above and below are provided over and under a sheet feed path leading from the feed rollers 16 to the paper ejection rollers 17. The upper CIS unit 18 is provided in the second housing 11, and the lower CIS unit 19 is provided in the first housing 12.

As shown in FIG. 1, a display unit 11B configured to display information is provided in a center of an upper surface 11A of the second housing 11. The display unit 11B includes a touch panel configured to act as an input device. The upper surface 11A and the display unit 11B do not face directly vertically upward but are slightly inclined forward. Therefore, the visibility and operability from the front of the image reading apparatus 1 can be improved. When the first tray 3, the second tray 5, and the third tray 7 are closed as shown in FIG. 2, an opening 5B formed in a center of the second tray 5 is located over the display unit 11B. Therefore, even when the first tray 3, the second tray 5, and the third tray 7 are closed, the display unit 11B is exposed through the opening 5B to allow for viewing and operation.

Figure 4:
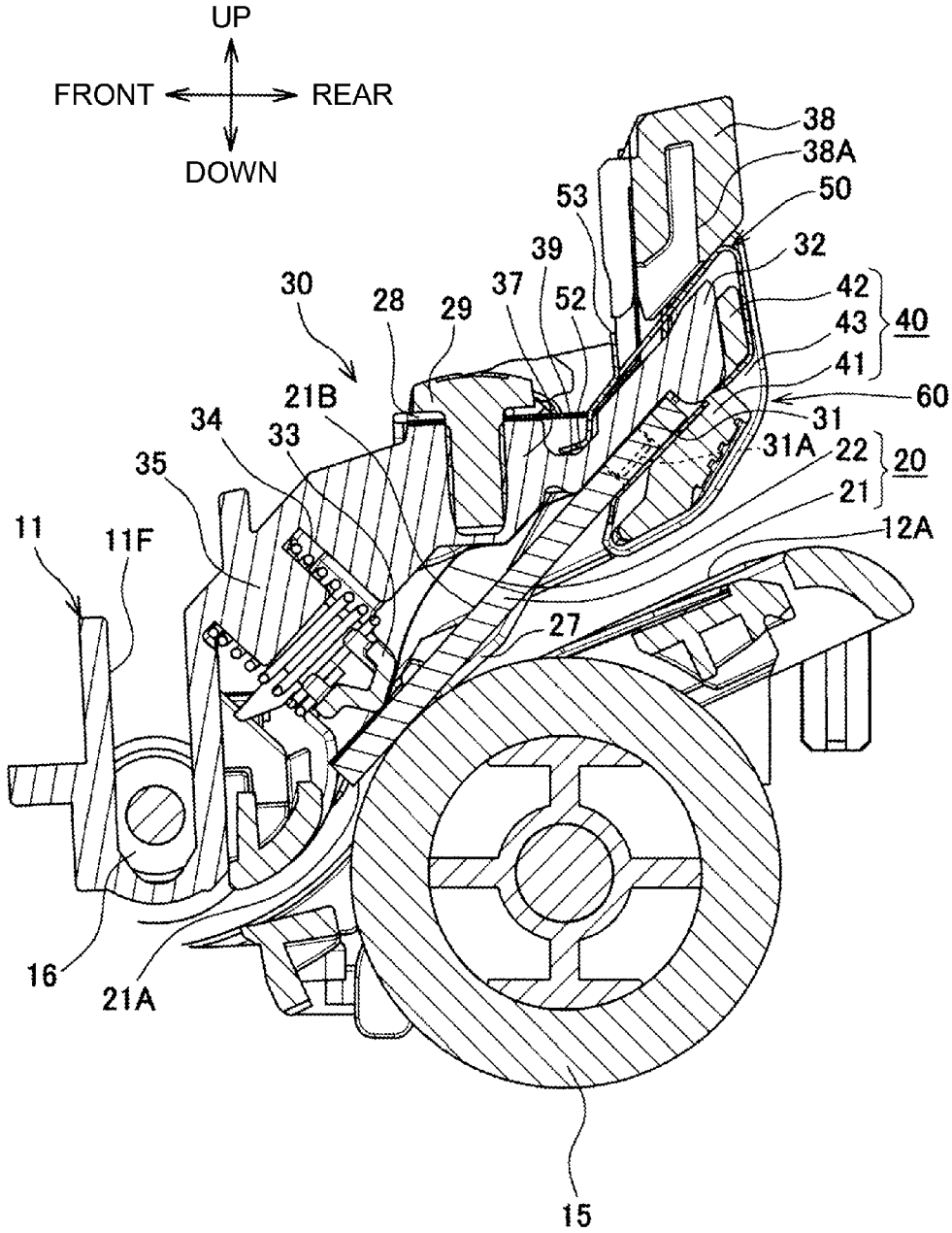
FIG. 4 is a sectional view showing an example configuration of the vicinity of the separation roller of the image reading apparatus.

As shown in FIG. 4, the second housing 11 has a supporting portion 30 in a part thereof behind a bearing portion 11F that bears the upper feed roller 16. The supporting portion 30 supports the separation pad assembly 20 and a pair of sheet holddown members 27 (see FIGS. 10A to 10C) disposed on the left and right sides of the separation pad assembly 20. The configuration of the supporting portion 30 will be described in further detail below.

As shown in FIG. 4, the separation pad 21 is supported by the supporting portion 30 on the upstream side in the sheet feed direction, e.g., the upper side of the separation pad 21. At the distal end of the separation pad 21 (e.g., in the sheet feed direction), the contact surface 21A is in contact with the separation roller 15. The aforementioned distal end of the separation pad 21 is located on the downstream side in the sheet feed direction, e.g., the lower side. A planar supporting surface 31 is formed on the lower surface of a rear part of the supporting portion 30. A bulge portion 32, an example of a second engaged portion, which bulges both upward and downward from the second housing 11, is formed at the rear end of the supporting surface 31. Two protrusions 31A and 31B are formed on the supporting surface 31 (see FIGS. 10A to 10C). Holes 20A and 20B formed in the separation pad assembly 20 are configured to engage with the protrusions 31A and 31B, respectively, and the separation pad assembly 20 is thereby attached to the supporting surface 31 (see FIGS. 5A to 5D). The holes 20A and 20B extend through the separation pad 21.

Figure 5A:
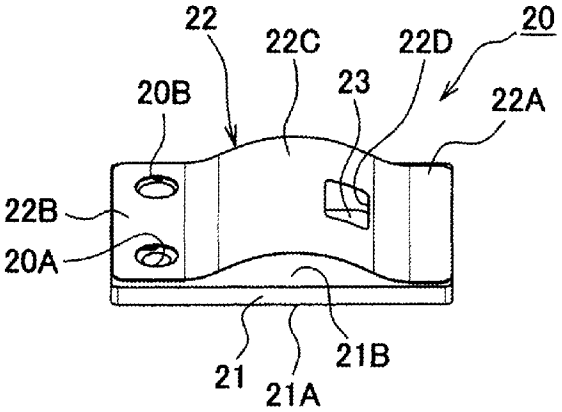
FIG. 5A is a perspective view showing the configuration of an example separation pad assembly according to an illustrative embodiment.

As shown in FIG. 5A, the separation pad 21 is formed of an elastic material in a sheet-like shape that is rectangular in plan view. For example, a silicone rubber containing cork may be used as an elastic material. The contact surface 21A of the separation pad 21 provides a feed resistance to the sheet in a position facing the separation roller 15. A film 22 made of resin, e.g., PET (polyethylene terephthalate) or the like is attached to a back surface 21B, an example of a second surface, opposite to the contact surface 21A. The film 22 is attached to the back surface 21B at the distal end portion 22A on the downstream side in the sheet feed direction and at the proximal end portion 22B on the upstream side. The film 22 is disposed in a bent state, and therefore the middle portion 22C between the distal end portion 22A and the proximal end portion 22B is out of contact with (e.g., does not contact) the back surface 21B. The proximal end portion 22B of the film 22 is attached to the back surface 21B of the separation pad 21 with a proximal end portion 23B of an elastomer sheet 23 therebetween. The elastomer sheet 23 is formed, for example, of acrylic elastomer. The elastomer sheet 23 extends, in the center in the left-right direction of the back surface 21B, along the back surface 21B. A distal end portion 23A of the elastomer sheet 23 is disposed between the middle portion 22C and the back surface 21B. An opening 22D is formed in a part of the middle portion 22C of the film 22 facing the distal end portion 23A of the elastomer sheet 23.

Figure 5B:
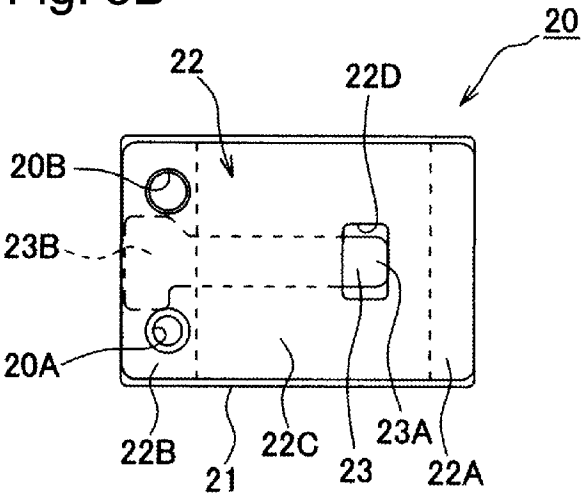
FIG. 5B is a plan view showing the configuration of the separation pad assembly according to an illustrative embodiment.

The holes 20A and 20B are formed in a part of the back surface 21B of the separation pad 21 to which the proximal end portion 22B of the film 22 is attached. The holes 20A and 20B are formed on both sides of the proximal end portion 23B of the elastomer sheet 23 as shown in FIG. 5B. The hole 20B is greater in diameter than the hole 20A, and accordingly, the protrusion 31B engaging with the hole 20B is greater in diameter than the protrusion 31A engaging with the hole 20A (see FIG. 10C). Therefore, the hole 20A is prevented from being accidentally engaged with the protrusion 31B, and the separation pad assembly 20 is thereby prevented from being attached to the supporting surface 31 in the incorrect orientation (e.g., with the wrong side up).

Returning to FIG. 4, a biasing member 33, a spring 34, and a spring receiving portion 35 are provided in a part of the supporting portion 30 facing the separation roller 15. One end of the spring 34 is attached to the biasing member 33. The other end of the spring 34 is borne by the spring receiving portion 35. The biasing member 33 is formed in an elongate shape extending throughout the width in the left-right direction of the separation pad assembly 20 (see FIG. 10C). The biasing member 33 receives basing force from the spring 34 and presses the separation pad assembly 20 toward the rotation axis of the separation roller 15.

The pair of sheet holddown members 27 is disposed on both the left and right sides of the separation pad 21 (e.g., one of members 27 on each side of separation pad 21). The pair of sheet holddown members 27 is in contact with the separation roller 15 and thereby biases the sheet against the separation roller 15. The pair of sheet holddown members 27 is connected to each other by a wire 28 for grounding. For example, the static electricity generated by friction is removed through the wire 28. The wire 28 is fixed to the supporting portion 30 with a screw 29 from above. A screwing portion 37 of the supporting portion 30, into which the screw 29 is screwed, bulges downward from the supporting portion 30, and is in contact with the film 22 when the separation pad assembly 20 is attached.

A protruding portion 38 is provided above the bulge portion 32. The protruding portion 38 is connected to the rear end face of the second housing 11, and is in contact with the upper surface 11A of the second housing 11 from below. A gap is formed between the protruding portion 38 and the bulge portion 32. A leaf spring 50 (e.g., an upper tongue portion 50B described in further detail below, see FIG. 6C) supporting a slider 40 can be inserted into the gap.

Figure 6A:
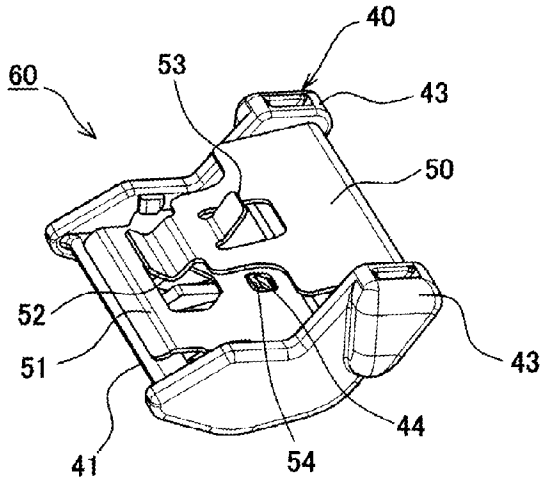
FIG. 6A is a perspective view showing the configuration of an example fixing member including a slider and a leaf spring attached to the slider according to illustrative aspects described herein.
Figure 6B:
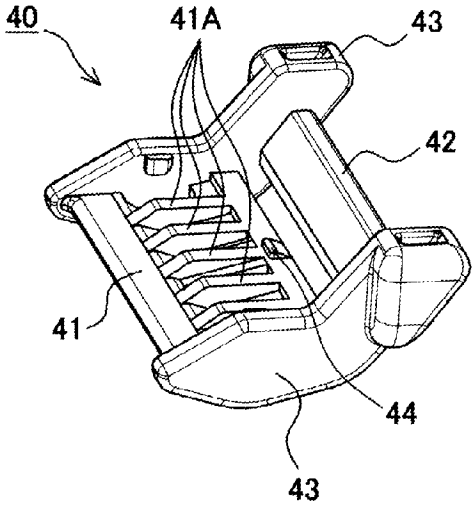
FIG. 6B is a perspective view showing an example configuration of the slider.

As shown in FIG. 6A, in one example, a fixing member 60 has a slider 40 made of resin, and a leaf spring 50 made of metal and attached to the slider 40. As shown in FIG. 6B, the slider 40 has a main body portion 41, a rear portion 42, and a pair of side plates 43. The main body portion 41 is disposed on the contact surface 21A side of the separation pad 21. A plurality of ribs 41A are formed on the upper surface of the main body portion 41 along the sheet feed direction. The rear portion 42 is disposed behind the bulge portion 32. The pair of side plates 43 supports the main body portion 41 and the rear portion 42 from both the left and right sides. The pair of side plates 43 supports the main body portion 41 and the rear portion 42 such that they separate from each other.

Figure 6C:
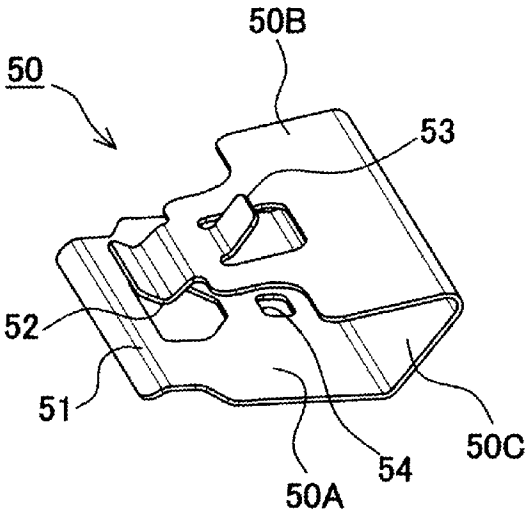
FIG. 6C is a perspective view showing an example configuration of the leaf spring.

As shown in FIG. 6C, the leaf spring 50 made of metal has a lower tongue portion 50A, an upper tongue portion 50B, and a connecting portion 50C. The lower tongue portion 50A is passed through a space surrounded by the main body portion 41, the rear portion 42, and the pair of side plates 43, and is placed on the upper surface of the main body portion 41. The upper tongue portion 50B is placed on the side of the supporting portion 30 opposite to the supporting surface 31. The lower tongue portion 50A and the upper tongue portion 50B are connected to each other at their rear ends by the connecting portion 50C. The connecting portion 50C is in contact with the rear end face of the rear portion 42. In the illustrated example, the leaf spring 50 is formed generally in a substantially C-shape (e.g., when viewed from the side). The lower tongue portion 50A is in contact with the upper surfaces of the plurality of ribs 41A. The distal end of the lower tongue portion 50A is bent downward (e.g., toward the main body portion 41). The proximal end of the bent part is a contact portion 51 that is in contact with the separation pad 21 in front of the ribs 41A.

An engaging portion 52 is formed at the distal end (e.g., relative to connecting portion 50C) of the upper tongue portion 50B. The engaging portion 52 is bent in a V-shape toward the lower tongue portion 50A. As shown in FIG. 4, a recess 39, an example of a first engaged portion, is formed in the side of the supporting portion 30 opposite to the supporting surface 31. The recess 39 engages with the engaging portion 52 when the leaf spring 50 is inserted in a forward direction (e.g., toward a front portion of the apparatus). A restricting portion 53 is formed in the upper tongue portion 50B. The restricting portion 53 is cut and raised in an upward direction, e.g., away from the lower tongue portion 50A. The restricting portion 53 comes into contact with the protruding portion 38 when the leaf spring 50 is extracted in a rearward direction from the supporting portion 30.

As shown in FIGS. 6A to 6C, when the leaf spring 50 is attached to the slider 40 and the connecting portion 50C comes into contact with the rear end face of the rear portion 42, a hook 44 formed on the main body portion 41 engages with a square hole 54 formed in the leaf spring 50. The leaf spring 50 is thereby fixed to the slider 40.

Figure 7:
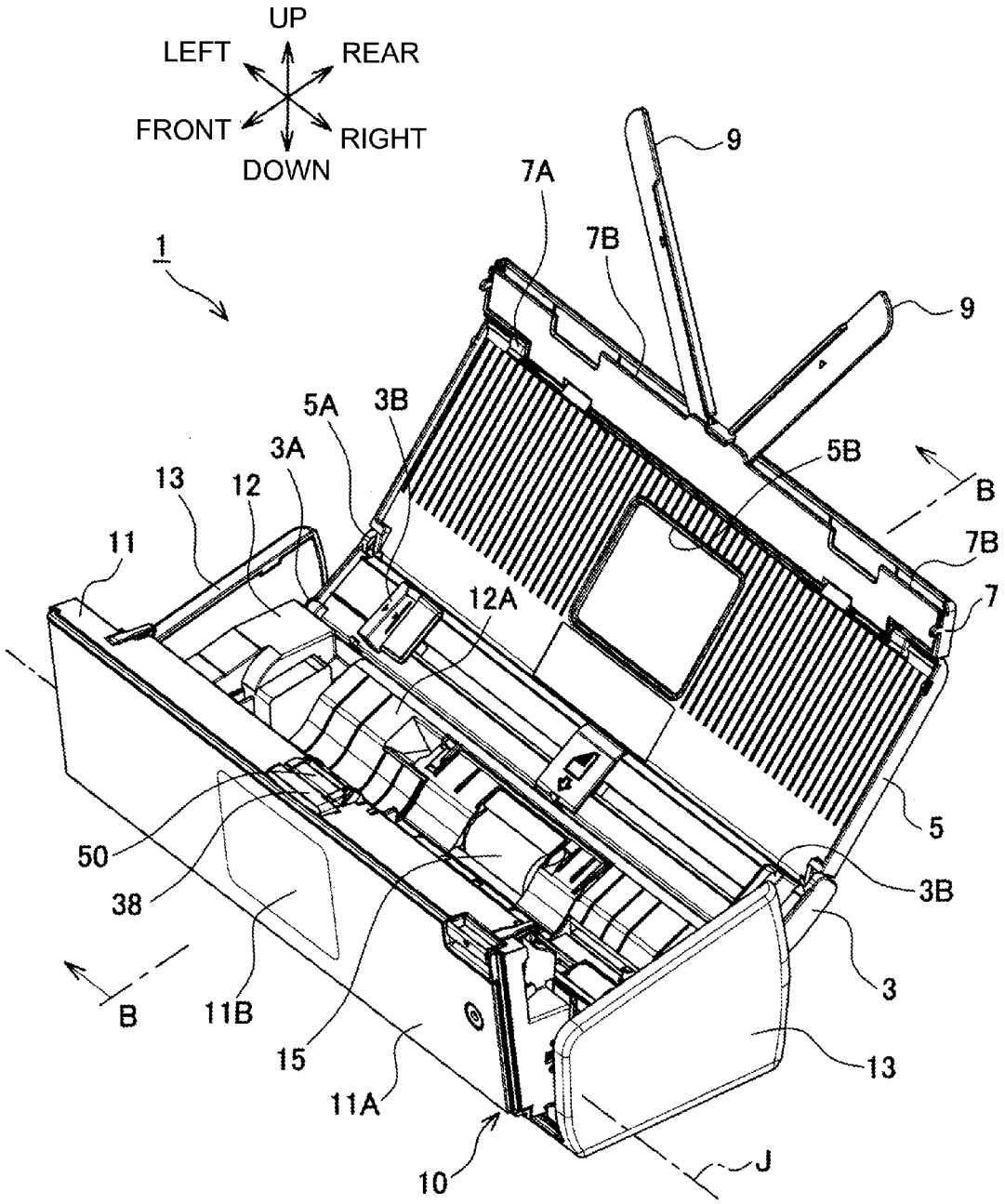
FIG. 7 is a perspective view showing the image reading apparatus with a pivotable housing open.
Figure 8:
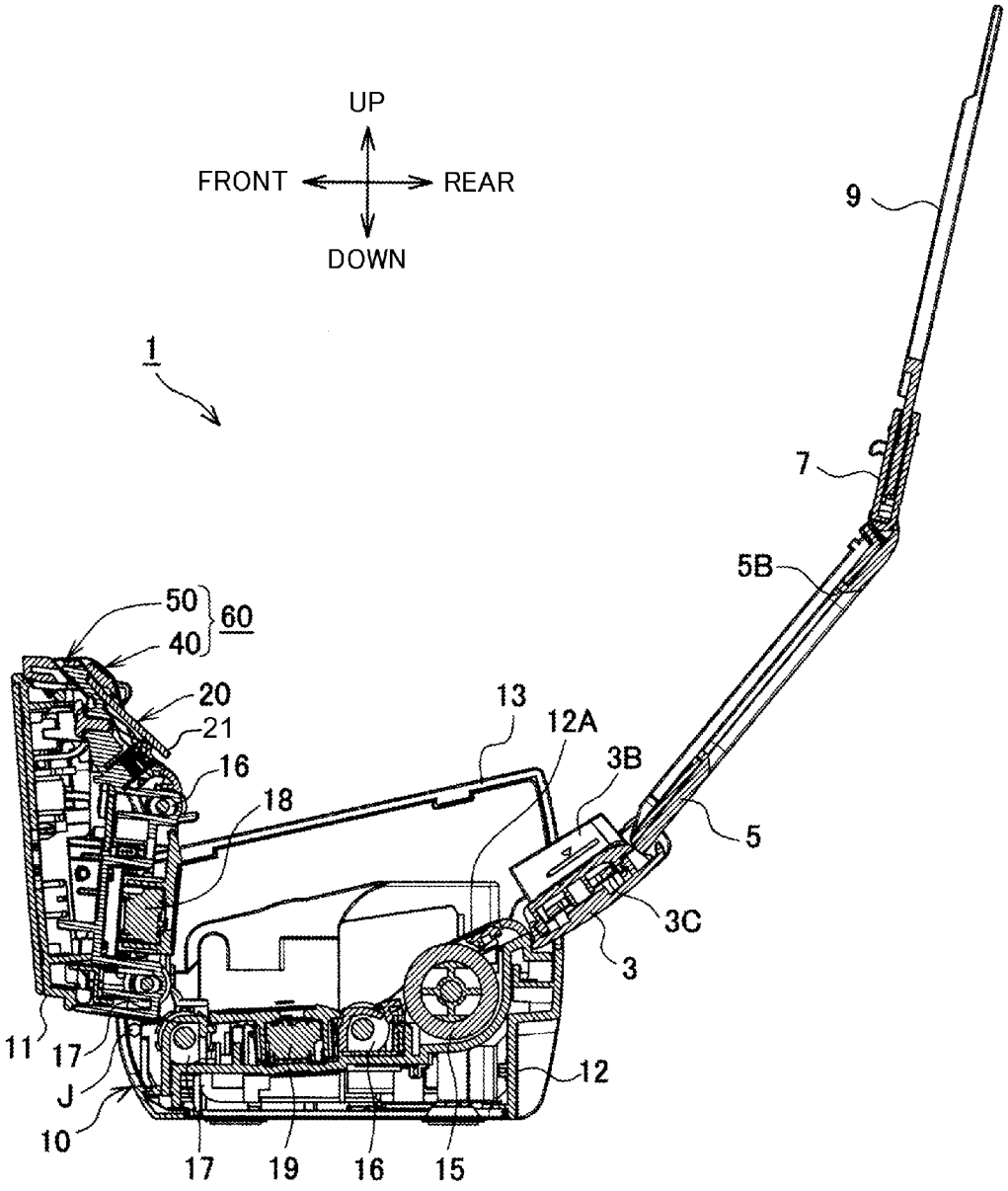
FIG. 8 is a sectional view taken along line B-B of FIG. 7.

As shown in FIG. 7 and FIG. 8, the second housing 11 is rotatably connected to the first housing 12. The second housing 11 rotates about a rotating axis J. The rotating axis J is located on the downstream side in the sheet feed direction of the separation pad 21, and extends in the left-right direction which is an example of a first direction. Therefore, the second housing 11 can be displaced between an abutting position where the separation pad 21 is in contact with the separation roller 15 (see FIG. 1 to FIG. 4) and a separation position where the separation pad 21 is separated from the separation roller 15 (see FIG. 7 and FIG. 8).

When the second housing 11 is in the separation position, the separation pad assembly 20 and the fixing member 60 are exposed above the image reading apparatus 1 as shown in FIG. 8, and therefore the separation pad assembly 20 can be easily replaced as follows. In the separation position, the contact surface 21A of the separation pad 21 is visible from above, and therefore the attrition condition of the contact surface 21A can be easily checked.

Figure 9B:
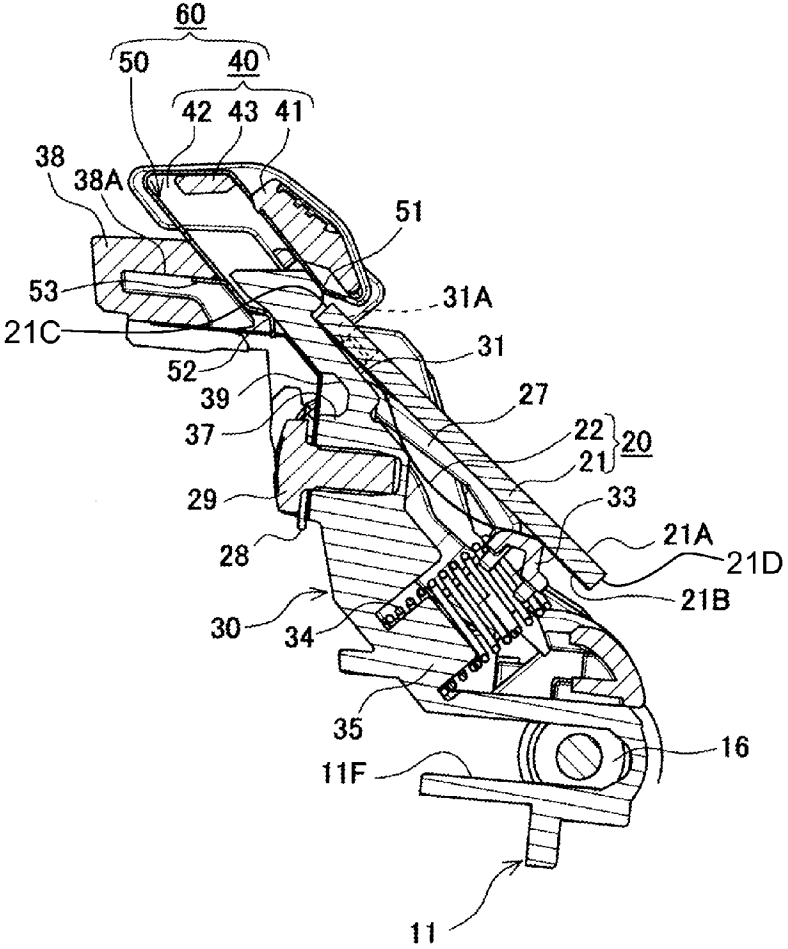
FIG. 9B is a sectional view showing a state in which the fixing member is located in a detachable position.
Figure 9A:
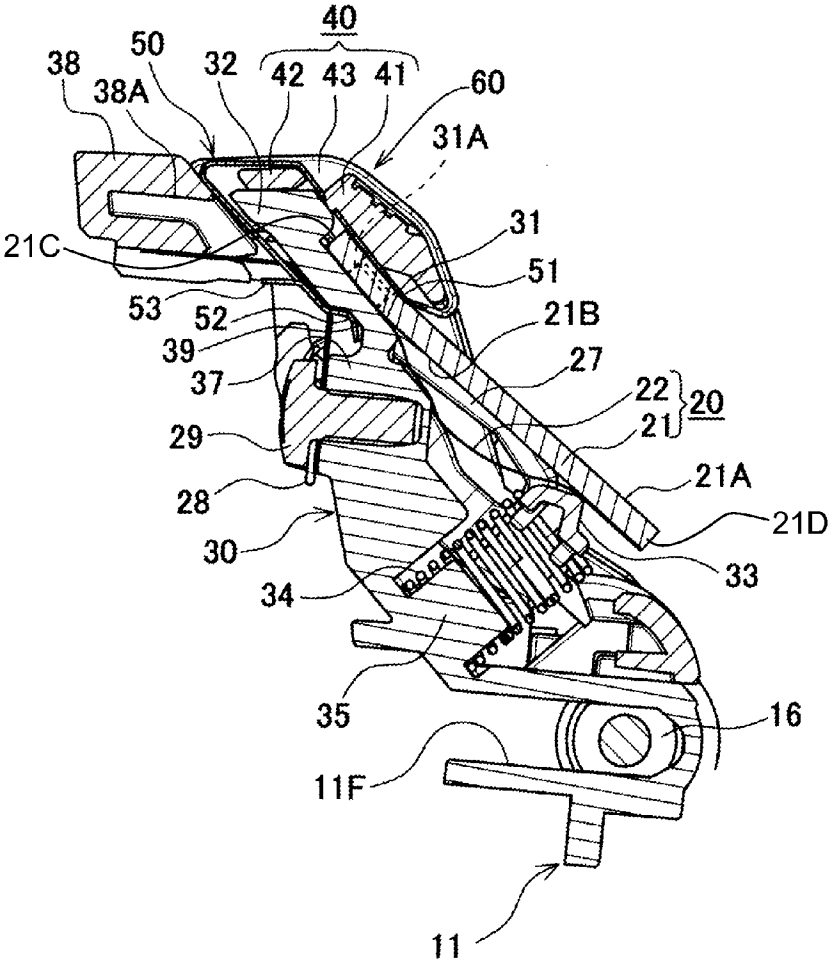
FIG. 9A is a sectional view showing a state in which the fixing member is located in a fixing position.

As shown in FIG. 9A, when the fixing member 60 is pushed to a fixing position, an example of a first position, where the rear portion 42 of the slider 40 is in contact with the bulge portion 32, the engaging portion 52 engages with the recess 39. The fixing member 60 is held stably in the fixing position. For example, the fixing member 60 covers a part of the contact surface 21A of the separation pad 21. At this time, the contact portion 51 is in contact with the contact surface 21A of the separation pad 21 on the downstream side in the sheet feed direction of the protrusions 31A and 31B. The contact portion 51 receives the restoring force of the leaf spring 50 and is biased against the contact surface 21A. Therefore, when the fixing member 60 is located in the fixing position, the protrusions 31A and 31B cannot be disengaged from the holes 20A and 20B, and the separation pad assembly 20 is well fixed to the supporting surface 31. FIGS. 9A and 9B are enlarged sectional views showing the movement of the vicinity of the separation pad assembly 20 in FIG. 8, and the position of the second housing 11 corresponds to that shown in FIG. 7 and FIG. 8.

When the fixing member 60 is moved upward, e.g., to the upstream side in the sheet feed direction, from the fixing position shown in FIG. 9A, the contact portion 51 moves along the contact surface 21A of the separation pad 21 while being in contact with the contact surface 21A, and comes out of contact with the separation pad 21 as shown in FIG. 9B. When the fixing member 60 is located in this detachable position, which is an example of a second position, the protrusions 31A and 31B can be disengaged from the holes 20A and 20B, and the separation pad assembly 20 can be detached from the supporting surface 31. When the fixing member 60 is located in the detachable position, the engaging portion 52 (an example of a second engaging portion) engages with the bulge portion 32, and the fixing member 60 is thereby held by the supporting portion 30. In addition, the restricting portion 53 comes into contact with the protruding portion 38, and the fixing member 60 is thereby restricted from moving upward, e.g., upstream in the sheet feed direction. Therefore, when the separation pad is replaced, the fixing member 60 can be held in the detachable position so as not to come off (e.g., detach from) the supporting portion 30.

The protruding portion 38 has, in its center, a hollow space extending in the left-right direction. The protruding portion 38 does not include a portion facing the leaf spring 50 on the downstream side in the sheet feed direction. The protruding portion 38 has a substantially U-shaped cross-section in side view. In the detachable position, the restricting portion 53 is in contact with a wall portion 38A of the protruding portion 38. The wall portion 38A, which is a longer wall of the protruding portion 38 than, e.g., an exterior wall of protruding portion 38, is located upstream in the sheet feed direction. When the fixing member 60 is moved from the detachable position to the fixing position, the contact portion 51 also moves along the contact surface 21A of the separation pad 21 while being in contact with the contact surface 21A.

Figure 10A:
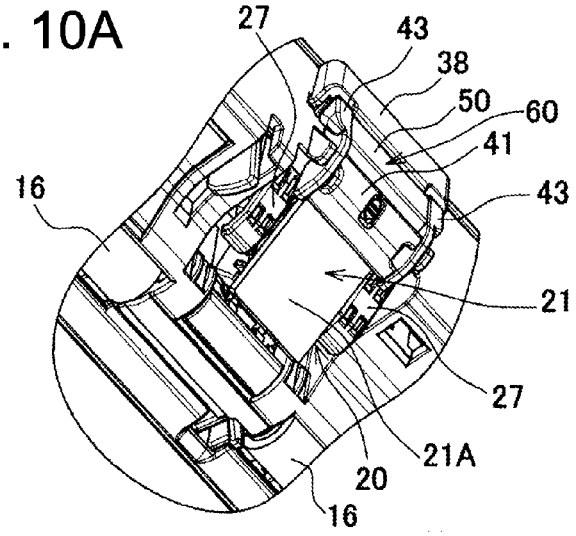
FIG. 10A is a perspective view showing a state in which the fixing member is located in the fixing position.
Figure 10B:
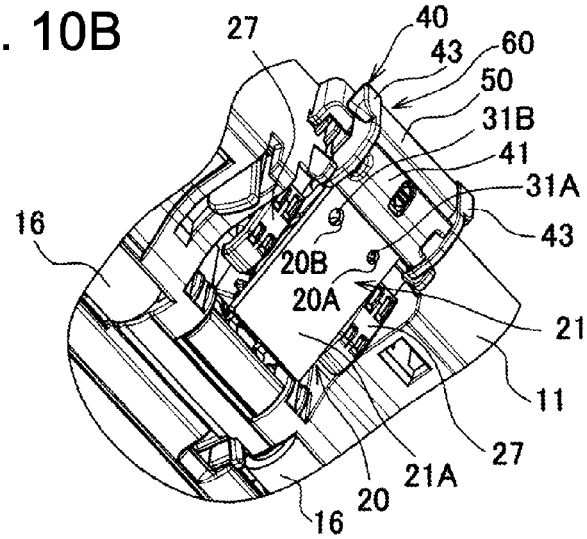
FIG. 10B is a perspective view showing a state in which the fixing member is located in the detachable position.
Figure 10C:
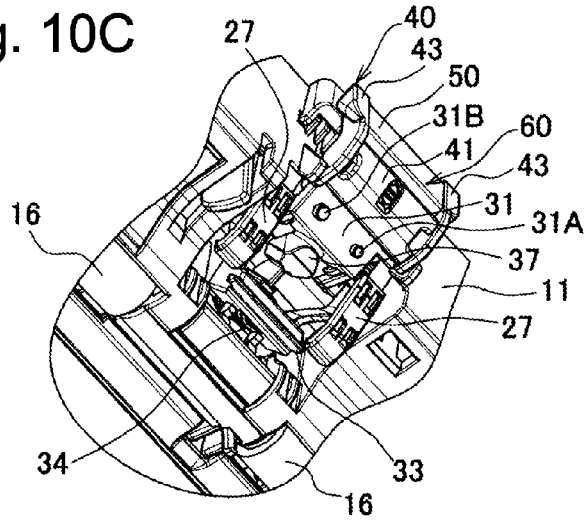
FIG. 10C is a perspective view showing a state in which the fixing member is located in the detachable position and the separation pad is removed.

In this embodiment, the replacement of the separation pad assembly 20 is made possible by moving the fixing member 60 from the fixing position shown in FIG. 10A to the detachable position shown in FIG. 10B. In the fixing position, the separation pad assembly 20 is fixed to the supporting surface 31 (see FIG. 10C). In the detachable position, the holes 20A and 20B of the separation pad assembly 20 can be disengaged from the protrusions 31A and 31B, and the fixing member 60 is not in contact with the separation pad assembly 20. From a state where the fixing member 60 is located in the detachable position, the separation pad assembly 20 can be detached as shown in FIG. 10C. When holes 20A and 20B of a new separation pad assembly 20 are engaged with the protrusions 31A and 31B as shown in FIG. 10B and the fixing member 60 is located in the fixing position as shown in FIG. 10A, the replacement of the separation pad assembly 20 is completed.

As described above, in this embodiment, the separation pad assembly 20 can be attached and detached directly to and from the second housing 11 with no need to combine the separation pad assembly 20 to a holder prior to attachment. Therefore, for example, when the contact surface 21A of the separation pad 21 is worn|[AM1], replacing the separation pad assembly 20 makes it possible to better feed sheets one at a time and to read images thereon with the CIS units 18 and 19. The separation pad assembly 20 is not combined with a holder or the like, and therefore the number of components can be reduced, the production cost can be reduced, and the apparatus can be well downsized.

The fixing position is on the downstream side in the sheet feed direction of the detachable position. Therefore, if the fixing member 60 comes into contact with the fed sheet at the time of image reading, the fixing member 60 is prevented from being dragged by the sheet and from thereby moving from the fixing position to the detachable position. In addition, the engaging portion 52 engages with the recess 39 in the fixing position, and therefore the fixing member 60 is better held in the fixing position. Therefore, in the fixing position, the separation pad assembly 20 can be fixed to the supporting surface 31 more stably.

In the fixing position, the contact portion 51 is in contact with the separation pad 21 on the downstream side, in the sheet feed direction, of the protrusions 31A and 31B, and is biased against the separation pad 21 by the leaf spring 50, and therefore the protrusions 31A and 31B can be better prevented from being disengaged from the holes. Therefore, the separation pad assembly 20 can be better fixed to the supporting surface 31.

Figure 5C:
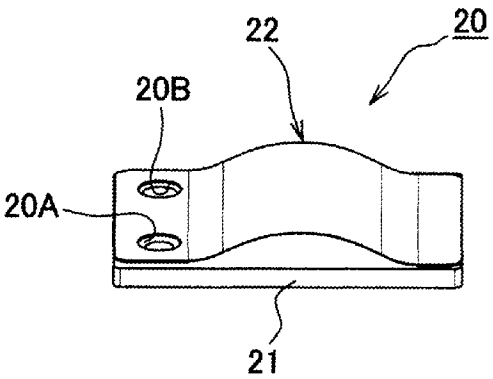
FIG. 5C is a perspective view showing the configuration of an example separation pad assembly according another illustrative embodiment.
Figure 5D:
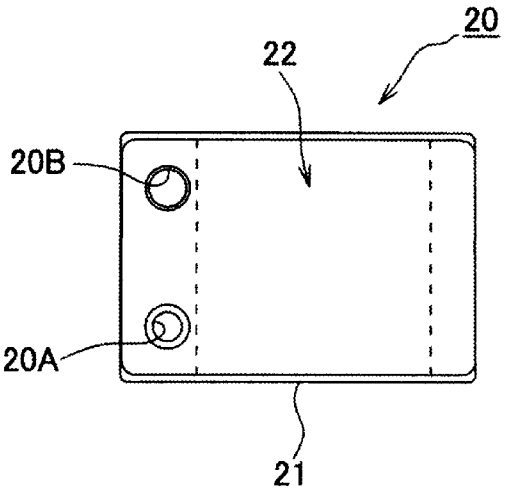
FIG. 5D is a plan view showing the configuration of the separation pad assembly according to the other illustrative embodiment.

The present disclosure is not limited to the embodiment, and may be embodied in various forms without departing from the scope of the present disclosure. For example, as shown in FIGS. 5C and 5D, the elastomer sheet 23 may be omitted, and the film 22 may also be omitted. The holes 20A and 20B, may be recesses that are not formed through the separation pad 21. The restricting portion 53 and so forth may be omitted, and the fixing member 60 may be easily detachable from the second housing 11. Although the contact portion 51 is in contact with the contact surface 21A that comes into contact with the sheet, the contact portion 51 may be in contact with the back surface 21B. The sheet feeding apparatus of the present disclosure can be used in various apparatuses such as an image forming apparatus.

What is claimed is:

1. A sheet feeder comprising:

a first roller configured to convey a sheet in a sheet conveyance direction;

a housing configured to pivot between an abutting position, in which the sheet feeder is configured to convey the sheet, and a separation position about an axis extending in a first direction, wherein the housing includes a protrusion;

a separation pad having at least one of a hole or a recess in which the protrusion is configured to be inserted, wherein, when the separation pad is attached to the housing, the separation pad contacts the first roller when the housing is in the abutting position and is separated from the first roller when the housing is in the separation position; and a fixing member connectable to the housing, wherein, when fixing member is connected to the housing and the housing is in the abutting position, the fixing member is slidable in the sheet conveyance direction, relative to the housing, between a first position and a second position along a first surface of the separation pad when the separation pad is attached to the housing, the first surface being opposite to a second surface of the separation pad that faces the housing, wherein, in the first position, the fixing member contacts the first surface of the separation pad with the separation pad attached to the housing, and, in the second position, the fixing member is spaced apart from the first surface of the separation pad, with the separation pad attached to the housing.

2. The sheet feeder according to claim 1, further comprising:

a second roller provided in the housing, wherein a rotational axis of the second roller is spaced apart from a rotational axis of the first roller in a second direction, the second direction being perpendicular to the first direction, wherein the fixing member is slidable in the second direction along the first surface of the separation pad.

3. The sheet feeder according to claim 2, wherein at least a portion of the fixing member is closer than the protrusion, in the second direction, to the second roller when the fixing member is in the first position.

4. The sheet feeder according to claim 3, wherein the at least a portion of the fixing member is farther than the protrusion, in the second direction, from the second roller when the fixing member is in the second position.

5. The sheet feeder according to claim 2, wherein:

the fixing member further comprises:

a leaf spring forming a part of a contact portion of the fixing member, configured to contact the first surface of the separation pad, the leaf spring being biased toward the first surface of the separation pad, and at least a part of the contact portion is disposed closer than the protrusion to the second roller in the second direction when the fixing member is in the first position.

6. The sheet feeder according to claim 5, wherein:

the housing further comprises:

a first engaged portion, and the leaf spring further comprises:

a first engaging portion configured to engage with the first engaged portion when the fixing member in the first position.

7. The sheet feeder according to claim 6, wherein:

the housing further comprises:

a second engaged portion being disposed further than the first engaged portion from the second roller in the second direction, and the leaf spring further comprises:

a second engaging portion configured to engage with the second engaged portion when the fixing member is in the second position.

8. The sheet feeder according to claim 2, the housing further comprising:

a biasing member configured to contact the second surface of the separation pad when the housing is in the abutting position; and an elastic member configured to bias the separation pad toward the first roller through the biasing member when the housing is in the abutting position.

9. The sheet feeder according to claim 8, wherein:

the at least one of the hole and the recess is formed in a distal end portion, relative to the second roller in the second direction, of the separation pad, and the biasing member is configured to be in contact with a proximal end portion, relative to the second roller in the second direction, of the separation pad.

10. The sheet feeder according to claim 9, wherein the separation pad bends away from the housing to increase a distance between the housing and the separation pad toward the proximal end portion of the separation pad when the housing is in the separation position.

11. The sheet feeder according to claim 9, further comprising:

a film attached to the second surface of the separation pad at both the proximal end portion and the distal end portion, the film being separated from the second surface between the proximal end portion and the distal end portion.

12. The sheet feeder according to claim 2, further comprising:

a sheet holddown member at a side of the separation pad in the first direction, the sheet holddown member configured to contact the first roller when the housing is in the abutting position.

13. The sheet feeder according to claim 12, wherein the sheet holddown member and the second roller are disposed on opposite sides, in the second direction, of a contact position between the first roller and the separation pad, and wherein at least a portion of the sheet holddown member is disposed closer than the separation pad to a rotational axis of the first roller in a third direction perpendicular to the first and second directions when the housing is in the abutting position.

14. The sheet feeder according to claim 1, further comprising:

a reader configured to read an image of a sheet fed through a contact position between the first roller and the separation pad.

15. The sheet feeder according to claim 1, wherein the fixing member includes an elastic member and wherein an entirety of the elastic member is slidable between the first and second positions while the fixing member is connected to the housing.

16. A sheet feeder comprising:

a first roller;

a first housing rotatably supporting the first roller;

a second housing pivotally connected to the first housing, the second housing including a first connection element and being pivotable between an abutting position, in which the sheet feeder is configured to convey a sheet, and a separation position about an axis extending in a first direction;

a separation pad including a second connection element configured to connect with the first connection element, wherein, when the separation pad is attached to the second housing, the separation pad contacts the first roller when the second housing is in the abutting position and is separated from the first roller when the second housing is in the separation position; and a fixing member connectable to the second housing, wherein, when fixing member is connected to the second housing and the second housing is in the abutting position, the fixing member is slidable, relative to the second housing, between a first position and a second position along a first surface of the separation pad when the separation pad is attached to the second housing, the first surface being opposite to a second surface of the separation pad that faces the second housing, wherein, in the first position, the fixing member contacts the first surface of the separation pad with the separation pad attached to the second housing, and, in the second position, the fixing member is separated from the first surface of the separation pad, with the separation pad attached to the second housing.

17. The sheet feeder according to claim 16, further comprising:

a second roller provided in the second housing, wherein a rotational axis of the second roller is spaced apart from a rotational axis of the first roller in a second direction, the second direction being perpendicular to the first direction, wherein the fixing member is slidable in the second direction along the first surface of the separation pad.

18. The sheet feeder according to claim 17, wherein at least a portion of the fixing member is closer than the first connection element, in the second direction, to the second roller when the fixing member is in the first position.

19. The sheet feeder according to claim 18, wherein the at least a portion of the fixing member is farther than the first connection element, in the second direction, from the second roller when the fixing member is in the second position.

20. The sheet feeder according to claim 16, wherein:

the first connection element includes a protrusion extending from the second housing, and the second connection element includes at least one of a hole and a recess in which the protrusion is configured to be inserted.

21. A sheet feeder comprising:

a first roller;

a first housing rotatably supporting the first roller;

a second housing pivotally connected to the first housing, the second housing being pivotable between an first position and a second position about an axis extending in a first direction, wherein the second housing includes a connection element and is configured to receive attachment of a separation pad via the connection element, the second housing configured to contact a first surface of the separation pad; and a fixing member connectable to the second housing, wherein the fixing member is slidable in a second direction, while connected to the second housing, between a first position and a second position, a portion of the fixing member configured to contact a second surface of the separation pad opposite to the first surface, the portion of the fixing member, when in the first position, overlapping the connection element in a third direction orthogonal to the second surface of the separation pad, and, when in the second position, exposing the connection element in the third direction.

* * * * *